US008269693B2

(12) United States Patent
Takagi et al.

(10) Patent No.: US 8,269,693 B2
(45) Date of Patent: Sep. 18, 2012

(54) METHOD OF DRIVING PLASMA DISPLAY PANEL AND PLASMA DISPLAY DEVICE

(75) Inventors: Akihiro Takagi, Kawaguchi (JP); Tetsuya Sakamoto, Yokohama (JP); Takayuki Kobayashi, Tokyo (JP); Takashi Sasaki, Hiratsuka (JP); Akira Otsuka, Zama (JP)

(73) Assignee: Hitachi, Ltd., Tokyo (JP)

( * ) Notice: Subject to any disclaimer, the term of this patent is extended or adjusted under 35 U.S.C. 154(b) by 232 days.

(21) Appl. No.: 12/667,170

(22) PCT Filed: Jun. 29, 2007

(86) PCT No.: PCT/JP2007/063124

§ 371 (c)(1),
(2), (4) Date: May 6, 2010

(87) PCT Pub. No.: WO2008/004685

PCT Pub. Date: Jan. 8, 2009

(65) Prior Publication Data

US 2010/0289794 A1 Nov. 18, 2010

(51) Int. Cl.
*G09G 3/28* (2006.01)

(52) U.S. Cl. ..... 345/60; 315/169.4

(58) Field of Classification Search ..... 345/213, 345/60–72; 315/169.4

See application file for complete search history.

(56) References Cited

U.S. PATENT DOCUMENTS

| | | | | |
|---|---|---|---|---|
| 6,538,627 | B1 * | 3/2003 | Whang et al. | 345/60 |
| 6,720,939 | B2 * | 4/2004 | Watabu | 345/60 |
| 7,102,597 | B2 | 9/2006 | Iwami | |
| 2005/0057450 | A1 | 3/2005 | Jeong | |
| 2006/0176246 | A1 | 8/2006 | Shoji et al. | |
| 2007/0262924 | A1 * | 11/2007 | Kim | 345/67 |

FOREIGN PATENT DOCUMENTS

| | | |
|---|---|---|
| JP | 2000-242225 | 9/2000 |
| JP | 2003-228318 | 8/2003 |
| JP | 2005-049823 | 2/2005 |
| JP | 2005-078097 | 3/2005 |
| JP | 2005-078098 | 3/2005 |
| JP | 2005121862 | 5/2005 |
| JP | 2005-157294 | 6/2005 |

OTHER PUBLICATIONS

Japanese Office Action issued in Japanese Patent Application No. 2009-521441 dated Apr. 10, 2012.

* cited by examiner

*Primary Examiner* — Stephen Sherman
(74) *Attorney, Agent, or Firm* — McDermott Will & Emery LLP

(57) ABSTRACT

In a PDP device, a technique capable of more efficiently performing address energy control according to contents of a display image (display data) to reduce the address energy. In the PDP device, as an address energy recovery circuit, a plurality of address energy control circuits (B1 to Bn) are provided corresponding to a plurality (n) of regions (H1 to Hn) into which a screen area (R) and a group of address electrodes are divided in a horizontal direction. For each of the regions (H) of which the address energy recovery circuits (B) are respectively in charge and for each of subfields, an address pulse switching load (Q) corresponding to that region (H) is determined, and then, according to the magnitude of the load (Q), the operation of the address energy recovery circuit (B) is ON/OFF-controlled.

4 Claims, 8 Drawing Sheets

DRIVING TIMING : SF1
H1
H2
Hn
M1
C1,1
Mk
Cj,k
R
L1
Lj
V
13
A1
A1_1
A1_m
Am
An_1
An_m
Ak
AD1
AD2
ADn
ON/OFF REPEAT
ALWAYS ON
ALWAYS OFF
ADDRESS DRIVER IC OPERATION :
LOAD (Q) :
LARGE
SMALL
ADDRESS ENERGY RECOVERY CIRCUIT OPERATION :
B1
B2
Bn
ON
OFF

DRIVING TIMING : SFN

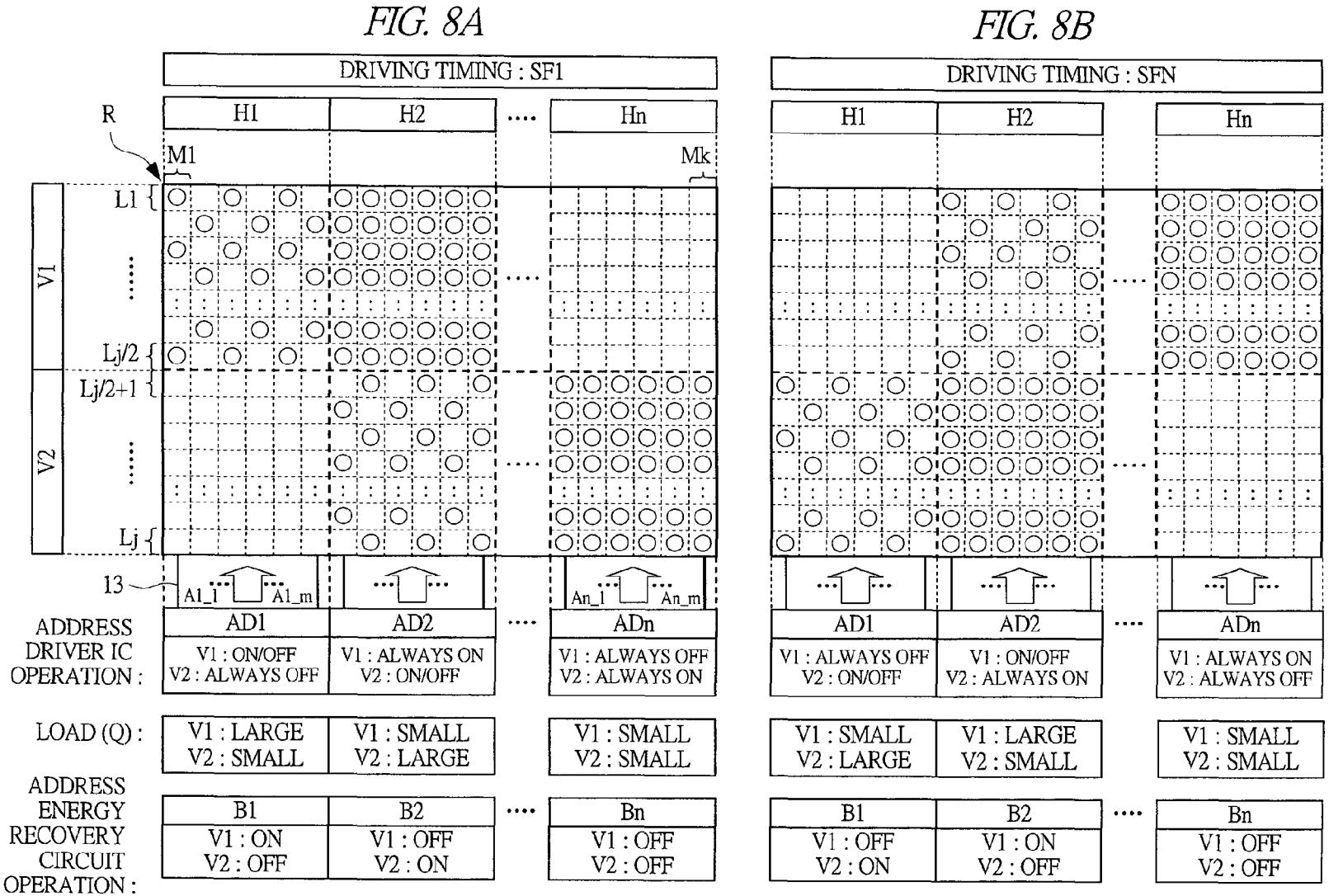
FIG. 8A
DRIVING TIMING : SF1
H1
H2
Hn
M1
Mk
R
L1
Lj/2
Lj/2+1
Lj
V1
V2
13
A1_1
A1_m
An_1
An_m
AD1
AD2
ADn
V1 : ON/OFF
V2 : ALWAYS OFF
V1 : ALWAYS ON
V2 : ON/OFF
V1 : ALWAYS OFF
V2 : ALWAYS ON
ADDRESS DRIVER IC OPERATION :
LOAD (Q) :
V1 : LARGE
V2 : SMALL
V1 : SMALL
V2 : LARGE
V1 : SMALL
V2 : SMALL
ADDRESS ENERGY RECOVERY CIRCUIT OPERATION :
B1
B2
Bn
V1 : ON
V2 : OFF
V1 : OFF
V2 : ON
V1 : OFF
V2 : OFF
FIG. 8B
DRIVING TIMING : SFN
H1
H2
Hn
AD1
AD2
ADn
V1 : ALWAYS OFF
V2 : ON/OFF
V1 : ON/OFF
V2 : ALWAYS ON
V1 : ALWAYS ON
V2 : ALWAYS OFF
V1 : SMALL
V2 : LARGE
V1 : LARGE
V2 : SMALL
V1 : SMALL
V2 : SMALL
B1
B2
Bn
V1 : OFF
V2 : ON
V1 : ON
V2 : OFF
V1 : OFF
V2 : OFF -- Prior Art --

-- Prior Art --

METHOD OF DRIVING PLASMA DISPLAY PANEL AND PLASMA DISPLAY DEVICE

RELATED APPLICATIONS

This application is the U.S. National Phase under 35 U.S.C. §371 of International Application No. PCT/JP2007/063124, filed on Jun. 29, 2007, the disclosure of which Application is incorporated by reference herein.

TECHNICAL FIELD

The present invention relates to a display device (plasma display device: PDP device) including a plasma display panel (PDP) and, in particular, it relates to address driving and energy control.

BACKGROUND ART

In a PDP device using a subfield method and an address-, display-period separation (ADS) method for displaying images on a PDP including address electrodes, an address energy recovery circuit is used in order to control consumption energy (address energy) upon driving the address electrodes.

Japanese Patent Application Laid-Open Publication No. 2005-78097 (Patent Document 1) discloses a PDP address energy control method. Patent Document 1 describes that the operation of the address energy recovery circuit is controlled on a subfield-by-subfield basis.

Japanese Patent Application Laid-Open Publication No. 2005-49823 (Patent Document 2) discloses an example of an address driver (data driver) that reduces consumption energy.

Patent Document 1: Japanese Patent Application Laid-Open Publication No. 2005-78097

Patent Document 2: Japanese Patent Application Laid-Open Publication No. 2005-49823

DISCLOSURE OF THE INVENTION

Problems to be Solved by the Invention

Address energy varies temporally and spatially depending on contents of a display image (display data) in a screen area and fields of a PDP (panel).

In the technique disclosed in Patent Document 1, a single address energy recovery circuit is provided for the panel to control the operation of the address energy recovery circuit across the board in the entire panel screen area. A unit of the control covers the entire screen area for each subfield. Thus, the magnitude, variations, and others of a load (address pulse switching load) for each partial region in the entire panel screen area are not considered or reflected in this control. Therefore, depending on contents of the display image (display data), an appropriate effect of an address energy reduction may not be achieved when, for example, regions with a large load and regions with a small load are mixed and eccentrically-located in the subfield and the entire panel screen area. In this case, for example, even when it is determined that the operation of the address energy recovery circuit is preferably turned ON for reducing the address energy in view of the entire panel screen area, the operation may be preferably turned OFF in a partial region. In this case, the operation is not turned OFF in this partial region, and therefore an appropriate effect cannot be achieved.

The present invention has been devised in view of the problems described above. A preferred aim of the present invention is to provide a technique of efficiently performing address energy control in a PDP according to contents of a display image (display data) to reduce address energy.

Means for Solving the Problems

The typical ones of the inventions disclosed in the present application will be briefly described as follows. To achieve the preferred aim mentioned above, the present invention is directed to a method of driving a plasma display (PDP) and a PDP device, in which an image is displayed by using a subfield technique and an ADS technique on a screen area of the PDP (panel) on which, for example, three types of electrodes (sustain electrode (represented as X), scan electrode (represented as Y), and address electrode (represented as A)) are formed. The method and device have a feature in a configuration as described below.

In the method and device, an address driving circuit and an address energy recovery circuit are used, the address driving circuit being connected to an address electrode group of the panel to apply an address driving waveform (address pulse group), and the address energy recovery circuit being connected to the address electrode group of the panel to recover energy for controlling consumption energy (address energy) at the time of driving the address electrodes. The address energy recovery circuit is configured to include a switch for controlling an LC resonance between an inductance of a coil and a capacitance of the panel (display cell).

(1) In the method and device, as a unit of control over the operation of the address energy recovery circuit (ON/OFF), in addition to each subfield, a region (H: horizontal-direction divided screen area or display column group region) obtained by dividing a screen area (R) and all the address electrode groups of the panel into several regions in a first direction (horizontal direction) is used. As the address energy recovery circuit, a plurality of address energy recovery circuits (address energy recovery circuit blocks: represented as B) are provided corresponding to each region (H) in the first direction.

In the method and device, for each subfield and for each of the regions (H) of which the address energy recovery circuit blocks (B) are respectively in charge in the first direction, a switching load (represented as Q) of an address pulse (address driving waveform) applied by an address driving circuit to an address electrode group in the region (H) is determined. Also, in the method and device, according to the magnitude of the load (Q) (for example, a determination by a comparison with a threshold-value), the address energy recovery operation is turned ON/OFF (switching control).

(2) In another method and device, as a unit of control, a region (V: vertical-direction divided screen area or display line group region) obtained by dividing the screen area (R) and all the address electrode groups of the panel into several regions in the second direction (vertical direction) is used. In the method and device, for each subfield and for each of the regions (V) in the second direction, a load (Q) onto the region (V) is determined in a manner similar to that of the item (1) above. Then, according to the magnitude of the load (Q), the address energy recovery operation is turned ON/OFF.

(3) In still another method and device, as a unit of control, regions (H) in a first direction and regions (V) in a second direction, that is, regions (H-V) divided by these regions, are each used. In the method and device, for each subfield and for each of the divided regions (H-V), a load (Q) onto the region (H-V) is determined in a similar manner. Then, according to the magnitude of the load (Q), the address energy recovery operation is turned ON/OFF.

According to the configuration described above, efficient address energy recovery control can be achieved corresponding to address energy varying according to contents of a display image (display data) with respect to the panel screen area and fields.

EFFECTS OF THE INVENTION

The effects obtained by typical aspects of the present invention will be briefly described below. According to the present invention, in a PDP device, address energy control can be efficiently performed more than ever according to contents of a display image (display data) so that address energy.

BRIEF DESCRIPTIONS OF THE DRAWINGS

FIG. 8A is a diagram illustrating operations of an address driving circuit and an address energy recovery circuit and others in an example of a display pattern in a panel screen area in a PDP device according to a second embodiment of the present invention, when a driving timing is SF1;

FIG. 8B is a diagram illustrating operations of the address driving circuit and the address energy recovery circuit and others in an example of the display pattern in the panel screen area in the PDP device according to the second embodiment of the present invention, when the driving timing is SFN;

Figure 9B:
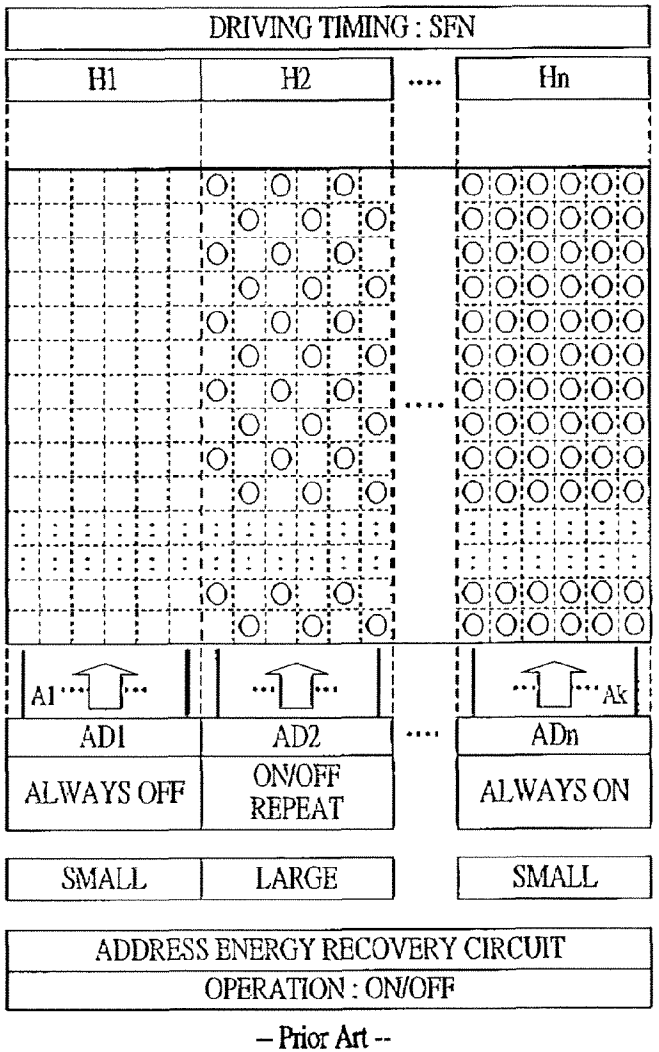
Figure 9A:
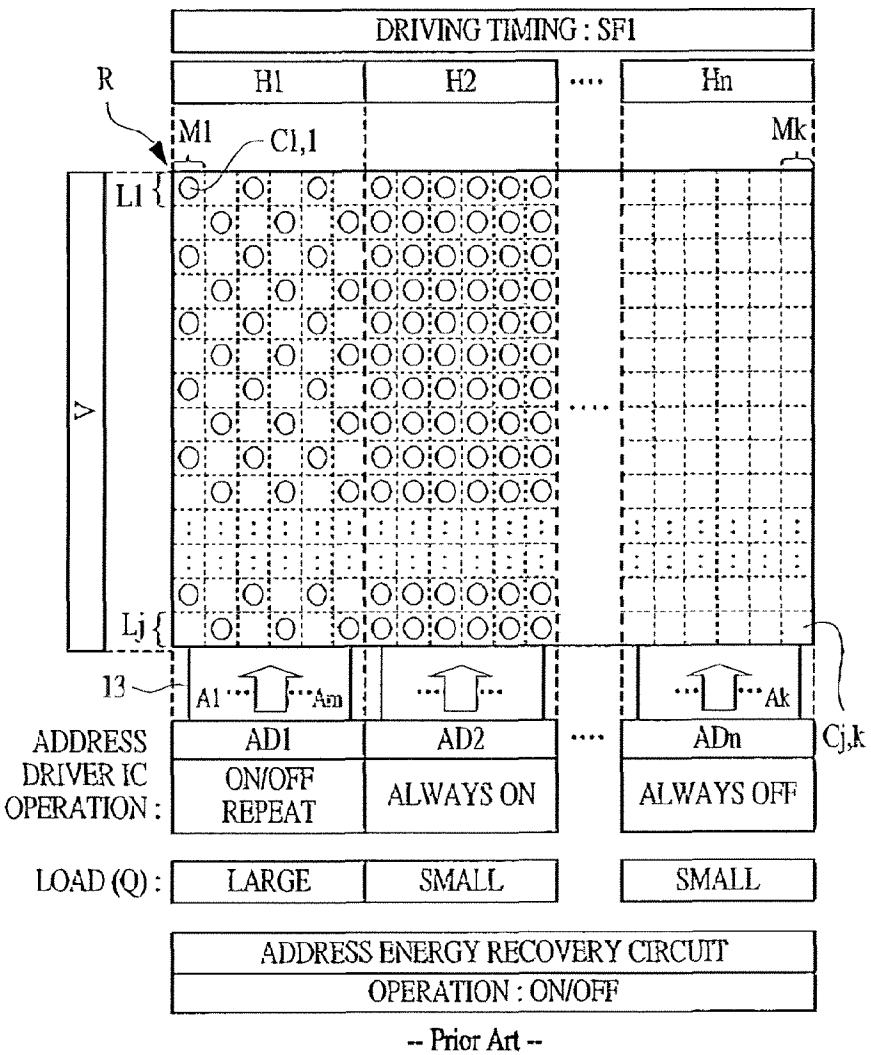

FIG. 9A is a diagram illustrating operations of an address driving circuit and an address energy recovery circuit and others in an example of a display pattern in a panel screen area in a PDP device according to a conventional technique, when a driving timing is SF1; and FIG. 9B is a diagram illustrating operations of the address driving circuit and the address energy recovery circuit and others in an example of the display pattern in the panel screen area in the PDP device according to the conventional technique, when the driving timing is SFN.

BEST MODE FOR CARRYING OUT THE INVENTION

Hereinafter, embodiments of the present invention will be described in detail with reference to the accompanying drawings. Note that components having the same function are denoted by the same reference symbols throughout the drawings for describing the embodiment, and the repetitive description thereof will be omitted. Hereinafter, a subfield is abbreviated as "SF".

<Conventional Technique>

With reference to FIGS. 9A and 9B, a conventional technique (corresponding to the technique disclosed in Patent Document 1) for embodiments of the present invention will be briefly described. FIGS. 9A and 9B each illustrate features of an operation of an address driving circuit and an operation of an address energy recovery circuit and others in an example of a display pattern in a panel screen area (R) in a PDP device according to the conventional technique. As to driving a plurality (N) of SFs (SF1 to SFN), FIG. 9A illustrates an example of the display pattern when the driving timing is SF1, and FIG. 9B illustrates an example of the display pattern when the driving timing is SFN.

In the screen area (R), regions in a vertical direction (display column or extending direction of the address electrode) are represented as V, and regions in a horizontal direction (display line or extending direction of a display electrode pair) are represented as H. In the screen area (R), a plurality (j pieces) of display lines (L1 to Lj) with a plurality (j lines) of display electrodes (sustain electrodes (X) and scan electrodes (Y)) are provided in V, and a plurality (k pieces) of display columns (M1 to Mk) with a plurality (k lines) of address electrodes (A1 to Ak) are provided in H, and, as these display lines and display columns crossing each together, display cell matrices (C1, 1 to Cj, k) are configured. For a group of address electrodes (A1 to Ak) of the panel, the address driving circuits are configured to be divided into a plurality (n) of address driver ICs (AD1 to ADn). A region (H) in a horizontal direction is illustrated as being divided into a plurality (n) of regions (H1 to Hn) corresponding to the plurality (n) of address driver ICs (AD1 to ADn).

In the conventional technique, with the entire panel screen area (R) and each SF taken as a unit, a display data change amount (address pulse switching load (Q) in the present embodiments) is determined, and based on this determination, whether to turn ON/OFF the operation of the address energy recovery circuit (LC resonant switch control) is determined. With ON/OFF of this operation, an address energy recovery in the entire screen area (R) is performed, thereby reducing the address energy. A single address energy recovery circuit is provided for the panel to control the operation of the address energy recovery circuit across the board in the entire panel screen area (R). Thus, the magnitude, variations, and others of a load for each partial region in the entire panel screen area (R) are not considered or reflected in this control. Therefore, depending on contents of the display image (display data), a proper effect of the address energy reduction may not be achieved when, for example, regions with a large load and regions with a small load are mixed and eccentrically-located in the SF and the entire panel screen area.

In FIG. 9A, at SF1, in the horizontal-direction divided screen area H1, as an operation of the corresponding first address driver IC (AD1) during an address period, an address driving waveform (address pulse group) to a plurality (m, where m=k/n) of corresponding address electrodes (A1 to Am) means a repeat of turning ON and OFF each time. That is, the display pattern of the region H1 is such that the cells in vertical and horizontal directions are alternately lit up and off. Here, "ON" (represented as a circle) means that the cell is lit up based on ON of an address pulse, and "OFF" (no mark) means that the cell is lit off based on OFF of an address pulse. Also, in the next region H2, as an operation of the second address driver IC (AD2), the address driving waveform is always ON. That is, the display pattern of the region H2 is such that the cells in vertical and horizontal directions are all lit up. Furthermore, in the last region Hn, as an operation of the n-th address driver IC (ADn), the address driving waveform is always OFF. That is, the display pattern of the region Hn is such that the cells in vertical and horizontal directions are all lit off.

In FIG. 9B, at SFN, in the region H1, as an operation of the first address driver IC AD1 during an address period, the address driving waveform is always OFF. In the region H2, as an operation of the first address driver IC AD1, the address driving waveform is alternately ON and OFF. In the region Hn, as an operation of the n-th address driver IC ADn, the address driving waveform is always ON. In this manner, the operation is changed in any of these regions (H1, H2, and Hn).

In FIGS. 9A and 9B, as for the load (Q) in each of the regions (H1 to Hn), Q is increased when the operation of the address driver IC is alternately turned ON and OFF, and Q is decreased when the operation of the address driver IC is always ON or always OFF. For each of the regions (H1 to Hn), irrespectively of the magnitude of the load (Q), ON/OFF is determined as an operation of a single address energy recovery circuit. That is, when portions with a large load are present more in the entire screen area (R) for each SF, it is determined that the load on the entire screen area (R) is large, thereby determining that the operation of the address energy recovery circuit is turned ON. In contrast, when portions with a small load are present more it is determined that the load on the entire screen area (R) is small, thereby determining that the operation of the address energy recovery circuit is turned OFF.

For this reason, for example, even though the operation of the address energy recovery circuit is preferably turned ON in a partial portion (for example, H1 in FIG. 9A) of the entire screen area (R), the operation of the address energy recovery circuit is determined to be turned OFF in the entire screen area (R) including other regions (for example, H2 and Hn in FIG. 9A). Therefore, a desirable effect of an address energy reduction cannot be achieved in that partial portion.

(First Embodiment)

In view of the foregoing, with reference to FIGS. 1 to 7B, a PDP device and a PDP driving method according to a first embodiment of the present invention will be described. In the first embodiment, as an address energy recovery circuit 40 for a panel screen area (R), a plurality of blocks are provided corresponding to a plurality (n) of divided screen areas (H) in a horizontal direction. For each regions (H) of which these address energy recovery circuits (B) 40-1 to 40-n are in charge, an address pulse switching load (Q) is determined. Based on the determination, ON/OFF of the operation of each address energy recovery circuit (B) is individually determined.

<PDP Device>

Figure 1:
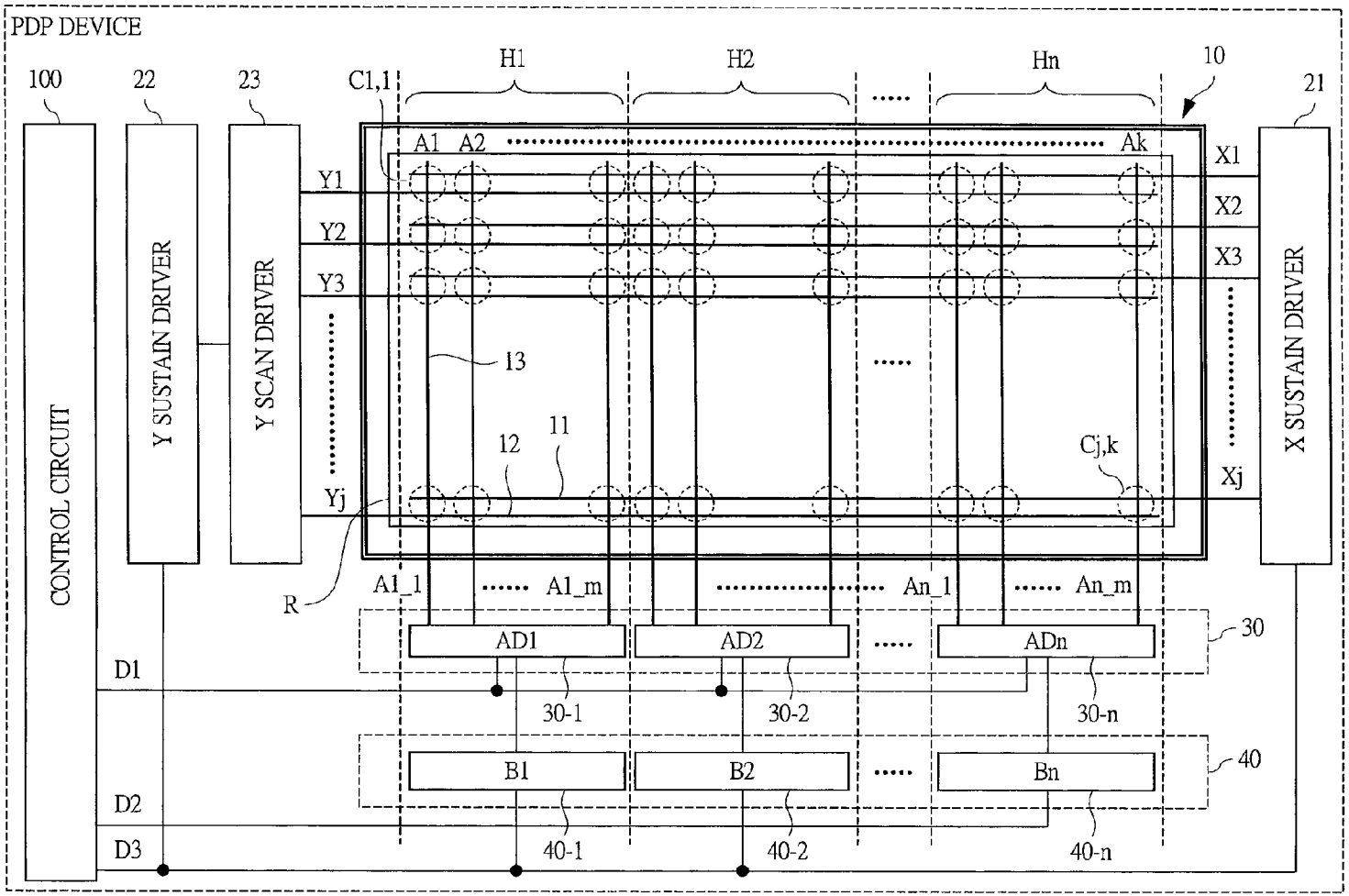
FIG. 1 is a diagram illustrating an entire structure of a PDP device according to a first embodiment of the present invention.

FIG. 1 illustrates the entire structure of the PDP device according to the first embodiment. The structure has a feature in which an address energy recovery circuits (40-1 to 40-n) is provided for each address driver IC (30-1 to 30-n) in a one-to-one correspondence.

The PDP device includes: a PDP 10; a control circuit 100; driving circuits (drivers) controlled by the control circuit 100, i.e., an X sustain driver 21, a Y sustain driver 22, a Y scan driver 23, and an address driver 30; and an address energy recovery circuit 40.

On the PDP (panel) 10, j lines of sustain electrodes (X) 11 (X1 to Xj) and j lines of scan electrodes (Y) 12 (Y1 to Yj) are alternately formed so as to extend in a first direction, and k lines of address electrodes (A1 to Ak) are formed so as to extend in a second direction.

The X sustain driver (sustain driving circuit) 21 drives and sustains a group of the sustain electrode (X) 11 based on a driving signal (D3) from the control circuit 100. The Y sustain driver (sustain driving circuit) 22 drives and sustains a group of the scan electrodes (Y) based on the driving signal (D3) from the control circuit 100. The Y scan driver (scan driving circuit) 23 scans and drives the scan electrodes (Y) group based on the driving signal (D3) from the control circuit 100. The address driver 30 drives addressing of a group of the address electrodes (A) 13 based on display data (D1) from the control circuit 100.

The address driver 30 is configured so as to be divided into a plurality (n) of address driver ICs (AD) 30-1 to 30-n. By way of example, n=12. Each address driver IC (ADi) 30-*i* is in charge of m lines of address electrodes (A) 13 and a corresponding horizontal-direction divided screen area (Hi) in the screen area (R) of the PDP 10. For example, the first address driver IC (AD1) 30-1 is in charge of an address electrode group corresponding to the first region H1 and its outputs (A1_1 to A1_*m*).

The address energy recovery circuit 40 is configured to be divided into a plurality (n) of address energy recovery circuits (B) 40-1 to 40-n. By way of example, n=12. Each address energy recovery circuit (Bi) 40-*i* is in charge of m lines of address electrodes (A) 13 and a corresponding horizontal-direction divided screen area (Hi) in the screen area (R) of the PDP 10. For example, the first address energy recovery circuit (B1) 40-1 is in charge of an address electrode group corresponding to the first region H1 and its outputs (A1_1 to A1_*m*). The address energy recovery circuit (B) compensates for the energy loss due to charge and discharge with respect to a panel capacitance, and recovers and uses reactive power associated with the address electrode group through an LC resonant operation.

The address energy recovery circuits (B1 to Bn) 40-1 to 40-n are connected to the address driver ICs (AD1 to ADn) 30-1 to 30-n. In this example, the address energy recovery circuits (B1 to Bn) 40-1 to 40-n are connected to the address driver ICs (AD1 to ADn) 30-1 to 30-n in a one-to-one correspondence.

The operation (ON/OFF switching) of each of the address energy recovery circuits (B1 to Bn) 40-1 to 40-n is individually controlled based on an operation control signal from the control circuit 100.

Here, the address energy recovery circuits 40 (B1 to Bn) and the address drivers 30 (AD1 to ADn) are not restricted to be in a one-to-one correspondence. For example, the structure may be such that six address energy recovery circuits (B1 to B6) are connected to twelve address drivers (AD1 to AD12).

<Control Circuit>

Figure 2:
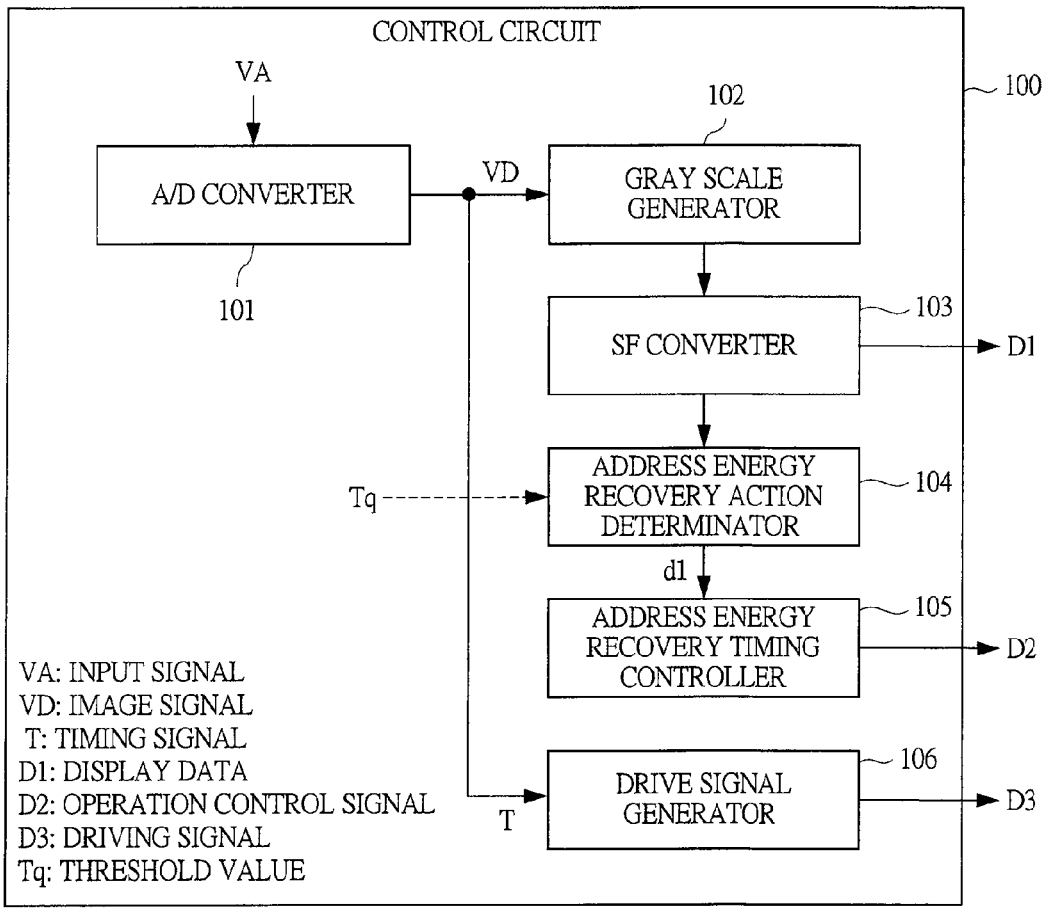
FIG. 2 is a diagram illustrating a configuration example of a control circuit in the PDP device according to the first embodiment of the present invention.

FIG. 2 illustrates a configuration example of the control circuit 100. The control circuit 100 includes, for example, an A/D converter 101, a grayscale generator 102, an SF converter 103, an address energy recovery action determinator 104, an address energy recovery timing controller 105, and a drive signal generator 106.

The A/D converter 101 performs A/D conversion or else on an input signal (VA), and then outputs, for example, a digital image signal (VD) and a timing signal (T), etc. The grayscale generator 102 performs an error diffusion process, dither process, or the like on the image signal (VD) to generate an image signal containing a grayscale, and then outputs the generated image signal to the SF converter 103. The SF converter 103 performs an SF conversion to create and output display data (field and SF data) (D1) for driving the PDP 10 for display. The display data (D1) contains data indicative of ON/OFF of a group of cells in a field (screen area (R)) for each SF. The drive signal generator 106 generates and outputs a driving signal (D3) for controlling driving of the X and Y drivers (21 to 23) based on the timing signal (T). In detail, the display data (D1) or the driving signal (D3) contains a switching control signal for switches in the address drivers 30 (AD1 to ADn).

The address energy recovery action determinator 104 determines, based on the display data (D1) from the SF converter 103, action (how to operate) of the address energy recovery circuits 40 (B1 to Bn). From contents of the display data (D1), the address energy recovery action determinator 104 determines an address pulse switching load (Q) for each SF and for each region H based on the operation of the address drivers 30 (AD1 to ADn), and then outputs a result (d1) of the determination. Also, as for the determination about the load (Q) at the address energy recovery action determinator 104, a predetermined threshold value (Tq) is set.

Based on the information (d1) from the address energy recovery action determinator 104, the address energy recovery timing controller 105 outputs a signal (D2) for controlling an ON/OFF operation of the address energy recovery circuits 40 (B1 to Bn) and their timings. In detail, the operation control signal (D3) contains a switching control signal for switches in the address energy recovery circuits 40.

<PDP>

Figure 3:
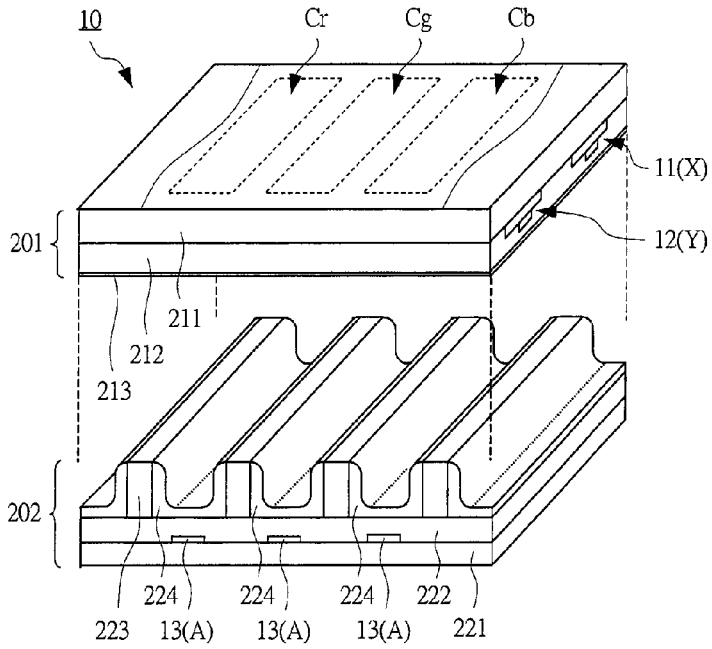
FIG. 3 is a diagram illustrating a configuration example of a PDP in the PDP device according to the first embodiment of the present invention.

FIG. 3 illustrates an example of a basic structure of the PDP 10, showing only a portion corresponding to a pixel (a set of cells of respective colors (Cr, Cg, Cb)) in the PDP 10. The PDP 10 is configured so that a structure body (front part 201) formed of a front glass substrate 211 and a structure body (rear part 202) formed of a rear glass substrate 221 are laminated to face each other, and a discharge gas is encapsulated between these structure bodies.

On the front part 201, a plurality of sustain electrodes (X) 11 and scan electrodes (Y) 12, which are both display electrodes, are formed to extend in parallel in a first direction (horizontal direction) and alternately in a second direction (vertical direction). Such a group of these display electrodes (11 and 12) is covered with a dielectric layer 212 and a protective layer 213. On the rear glass substrate 221 of the rear part 202, a plurality of address electrodes (A) 13 are formed so as to extend in parallel to each other in the second direction, and are further covered with a dielectric layer 222. On the dielectric layer 222 and both sides of the address electrode 33, a barrier rib 223 is formed so as to extend in the second direction, for example. Furthermore, on the dielectric layer 222 and between the barrier ribs 23, a phosphor 224 generating visible light of a color of red (R), green (G), or blue (B) as being excited by ultraviolet rays is formed for each column. A pair of display electrodes (11 and 12) corresponds to a display line (L). A section defined by the address electrodes 13 and the barrier ribs 223 corresponds to a display column (M). A region defined by the electrodes (11, 12, and 13) crossing each other, that is, a region defined by the display lines (L) and display columns (M) corresponds to a display cell (C).

<Field>

Figure 4:
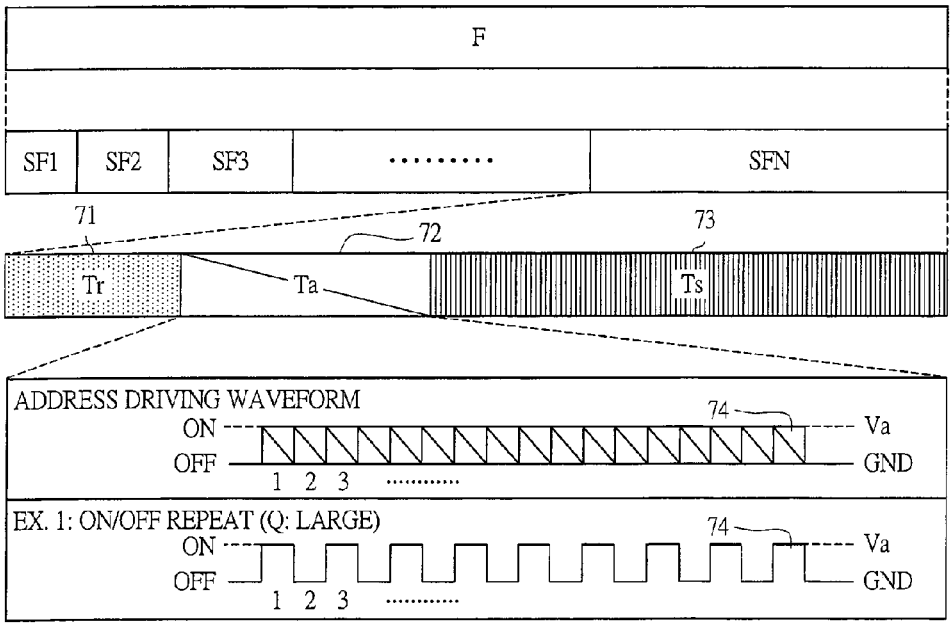
FIG. 4 is a diagram illustrating a field configuration in the PDP device according to the first embodiment of the present invention.

FIG. 4 illustrates a basic field configuration (driving sequence) in drive control of PD 10. A field (field period) (F) is a unit corresponding to the screen area (R) of the PDP 10, a predetermined period (for example, 1/60 second), a video image frame, or the like. The field (F) is configured by a plurality (N) of SFs (SF1 to SFN) obtained through temporal division for grayscale representation. Each SF is configured by a reset period (Tr) 71, an address period (Ta) 72, and a sustain period (Ts) 73, for example. Each SF is given a weighting of brightness based on, for example, the number of times of sustain discharges in the sustain period (Ts) 73. Grayscale representation is achieved by a step of selective combination of ON (turn-on)/OFF (turn-off) for each SF in each cell of the field (F).

In the reset period (Tr) 71, an operation in preparation for the next address period (Ta) is performed. In the address period (Ta) 72, an operation of selecting ON (turn-on)/OFF (turn-off) in a group of cells in a SF is performed. That is, according to the display data and the selected cell, a scan pulse to the scan electrode (Y) 12 and an address pulse 74 to the address electrode (A) 13 are applied to a group of the display lines (L) to be driven sequentially (for example, from L1 to Lj) at the same timing, thereby generating address discharge at the selected cell. In the next sustain period (Ts) 73, with a sustain pulse being applied to the group of display electrodes (11 and 12), sustain discharge is generated at the selected cell in the immediately-preceding address period (Ta) 72 for turning on.

FIG. 4 also illustrates, on its lower side, an address driving waveform (group of address pulses 74) to be applied to the group of address electrodes 13 by the address driver 30 in the address period (Ta) 72. For each address electrode 13, the address pulse 74 is turned ON/OFF (1, 2, 3, . . . ) corresponding to the cell (C). The address pulse 74 is at a ground (GND) potential when it is in an OFF state, and is at an address voltage (Va) potential when it is in an ON state. Furthermore, alternate ON/OFF repetitions of the address pulse 74 is illustrated as a first example of the address driving waveform. In this case, the switching load (Q) of the address pulse 74 becomes large.

The switching load (Q) of the address pulse is a load of ON/OFF switching corresponding to cell selection due to the application of the group of address pulses 74 to the group of address electrodes 13 according to the display data, and the Q is increased as the ON/OFF state at an adjacent display cell (or adjacent display line or adjacent display column) is changed more and Q is decreased as the ON/OFF state at an adjacent display cell (or adjacent display line or adjacent display column) is changed less. This load Q includes a load of circuit charge/discharge (relatively small) and a load of panel charge/discharge (relatively large).

<Control>

Figures 5A, 5B:
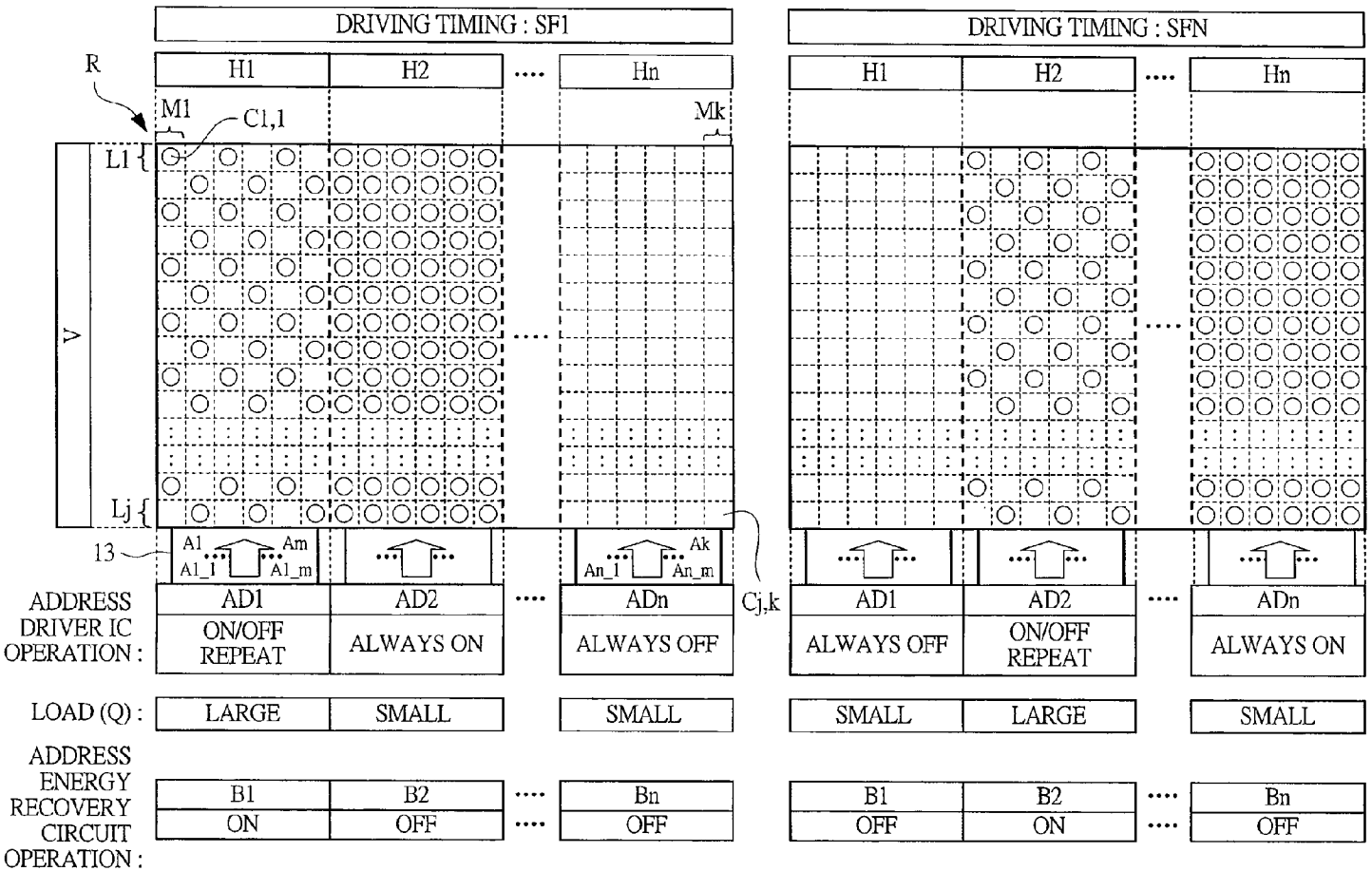
FIG. 5A is a diagram illustrating operations of an address driving circuit and an address energy recovery circuit and others in an example of a display pattern in a panel screen area as control contents in the PDP device according to the first embodiment of the present invention, when a driving timing is SF1.
FIG. 5B is a diagram illustrating operations of the address driving circuit and the address energy recovery circuit and others in the example of the display pattern in the panel screen area as control contents in the PDP device according to the first embodiment of the present invention, when the driving timing is SFN.

Next, FIGS. 5A and 5B illustrate a feature of the operation of the address driving circuit 30 and the operation of the address energy recovery circuit 40 in examples of display patterns in the panel screen area (R) as control details of the PDP device and PDP driving method according to the first embodiment. In a driving of the plurality (N) of SFs (SF1 to SFN) of the field, FIG. 5A illustrates an example of a display pattern when the driving timing is SF1, and FIG. 5B illustrates an example of a display pattern when the driving timing is SFN.

In the screen area (R), regions in a vertical direction (display column (M) or address electrode (A) 13 direction) are represented as V, and regions in a horizontal direction (display line (L) or display electrode pair (11 and 12) direction) are represented as H. The screen area (R) includes a plurality (j pieces) of display lines (Li to Lj) with a plurality (j lines) of display electrode pairs (11 and 12) in V, and also includes a plurality (k pieces) of display columns (M1 to Mk) with a plurality (k lines) of address electrodes (A1 to Ak) in H. With these lines and columns crossing, display cell matrices (C1, 1 to Cj, k) are configured. The screen area (R) of the panel and the group of address electrodes 13 (A1 to Ak) are managed as a plurality (n) of divided screen areas (H1 to Hn) in the horizontal direction with respect to a plurality of (n) address driver ICs (AD1 to ADn) 30-1 to 30-n.

In the first embodiment, as control contents, with each of the divided screen areas (H1 to Hn) in the entire panel screen area (R) in a horizontal direction and each SF being taken as a unit, an address pulse switching load (Q) is determined. Based on this determination result, ON/OFF of the operation (LC resonant switch control) of the address energy recovery circuit (B) corresponding to each region (H) is determined. With this ON/OFF of the operation, the address energy can be reduced through address energy recovery in each divided screen area (H).

For each of the divided screen areas (H1 to Hn), the operation of each of the address energy recovery circuits (B) 40-1 to 40-n is controlled, and thus, the magnitude, variations and others of the load (Q) for each region (H) in the entire screen area (R) are considered and reflected in this control. Therefore, depending on contents of the display image (display data), a proper effect of an address energy reduction can be achieved even when, for example, regions with a large load (Q) and regions with a small load (Q) are mixed and eccentrically-located in the SF and the entire panel screen area (R).

In FIG. 5A, at SF1, in the divided screen area H1, as an operation of the corresponding first address driver IC (AD1) 30-1 during the address period (Ta) 72, the address driving waveform (group of address pulses 74) to a plurality of (m, m=k/n) address electrodes (A1 to Am) is alternately turned ON and OFF. Here, "ON" (represented as a circle) means that turn-on of the cell is selected based on "ON" of the address pulse 74, and "OFF" (no mark) means that turning-off of the cell is selected based on OFF of the address pulse 74. In the adjacent region H2, as an operation of the second address driver IC (AD2) 30-2, the address driving waveform is always ON. In the last region Hn, as an operation of the n-th address driver IC (ADn) 30-n, the address driving waveform is always OFF.

In FIG. 5B, at SFN, in the divided screen area H1, as an operation of the address driver IC AD1 in the address period (Ta) 72, the address driving waveform is always OFF. In the divided screen area H2, as an operation of the address driver IC AD1, the address driving waveform is alternately turned ON and OFF. Also, in the divided screen area Hn, as an operation of the address driver IC ADn, the address driving waveform is always OFF. In any of these regions (H1, H2, and Hn), the contents of the display data and the operation are changed.

In FIGS. 5A and 5B, as for the load (Q) in each of the regions (H1 to Hn), the load Q is increased when the address driver IC (AD) is alternately turned ON/OFF. When it is always ON or always OFF, the load Q is decreased. Then, for each of the regions (H1 to Hn), according to the magnitude of the load Q, ON/OFF of the operation of each of the plurality (n) of address energy recovery circuits (B) 40-1 and 40-n is each determined. That is, in a region (H) with a large load (Q) in the entire screen area (R) for each SF, it is selected that the operation of the address energy recovery circuit (B) is turned ON, and in contrast, in a region (H) with a small load (Q), it is selected that the operation of the address energy recovery circuit (B) is turned OFF.

Thus, in a partial region, for example, in the region H1 at the time of SF1 in FIG. 5A, it is properly selected that the operation of the address energy recovery circuit is turned ON. In another region, such as H2 or Hn, it is properly selected that the operation of the address energy recovery circuit is turned OFF. As a whole, a desirable effect of reducing the address energy can be obtained.

<Address Driver and Address Energy Recovery Circuit>

Figure 6:
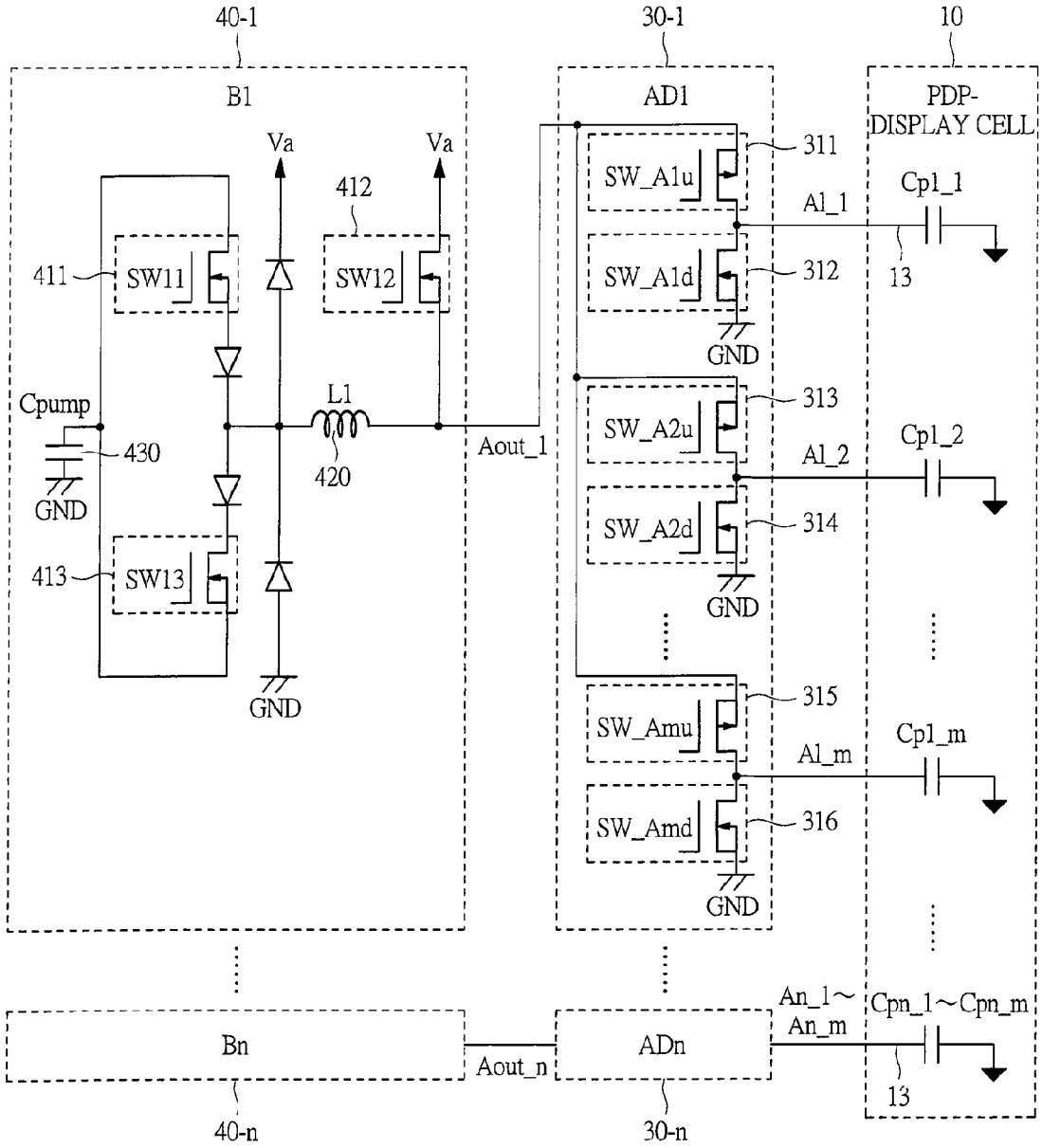
FIG. 6 is a diagram illustrating a circuit configuration example of an address driver and the address energy recovery circuit in the PDP device according to the first embodiment of the present invention.

FIG. 6 illustrates a circuit configuration example of the address driver 30 and the address energy recovery circuit 40. The first address driver IC (AD1) 30-1 to the n-th address driver IC (ADn) 30-n in the address driver 30 have a similar structure. Also, the first address energy recovery circuit (B1) 40-1 to the n-th address energy recovery circuit (Bn) 40-n in the address energy recovery circuit 40 have a similar structure. The address driver IC AD1, the address energy recovery circuit B1, and corresponding display cells (panel capacitances: Cp1_1 to Cp1_*m*) of the PDP 10 will be described below by way of example.

An output (Aout_1) from the first address energy recovery circuit (B1) 40-1 serves as an input to the first address driver IC (AD1) 30-1. Each of outputs (A1_1 to A1_*m*) from the first address driver IC (AD1) 30-1 represent output waveforms to each of the corresponding display cells (panel capacitances: Cp1_1 to Cp1_*m*) and address electrodes 13 (A1 to Am) of the PDP 10. As a panel capacitance (Cp), for example, Cp1_1 is present on a line of the output (A1_1) to the first address electrode 11 (A1).

In the first address energy recovery circuit (B1) 40-1, to a line of the output Aout_1, a coil (inductance: L1) 420 for energy recovery is connected. With the coil (L1) 420 and the panel capacitance (Cp), LC resonance occurs. To another end (left side) of the line of the coil 420, lines including two switches (SW11 and SW13) for LC resonant control are connected in parallel. The lines of these switches (SW11 and SW13) are connected to lines of a capacitance (Cpump) 430 connected to ground (GND). The switch (SW11) 411 on an upper side for LC resonant control is to control LC resonance UP (charge (electrical-charge supply) to the panel capacitance), and the switch (SW13) 413 on a lower side is to control LC resonance DOWN (discharge from the panel capacitance (electrical-charge recovery)). To each of these switches (SW11 and SW13), rectifier diodes are connected in series. For the capacitance (Cpump) 430, the address energy is recovered.

Also, to one end (right side) of the coil 420, a line including an address voltage (Va) power supply and a switch (SW12) 412 is connected. The switch (SW12) 412 is for Va clamp control. In one configuration example, no ground (GND) line is connected to one end (right side) of the coil 420. Also, to the other end (left side) of the coil 420, a line of the address voltage (Va) power supply and a diode (clamp diode) are connected to a line of the ground (GND) and the diode (clamp diode).

In the first address driver IC (AD1) 30-1, two switches (in pair) for up/down control of the address pulse 74 is connected to each address electrode 13 (output line). For example, to a line of the output (A1_1) to the first address electrode 13 (A1) and between that line and a line of B1 output (Aout_1), a switch (SW_A1*u*) 311 for up control is connected. To the other line and between that line and the ground (GND), a switch (SW_A1*d*) 312 for down control is connected. With the switch (SW_A1*u*) 311 on an upper side turned ON (High), clamp up to Va is done (however, turning the switch SW12 ON is required). Also, with control over the switch (SW_A1*d*) 312 on a lower side, a drop to the ground potential is done.

Each of the switches (for example, SW11, SW12, SW13, and SW_A1*u/d*) is configured to include a switching element, such as an FET. The operation of each of these switches is switched between ON and OFF through an input of a control signal (such as the display data (D1)).

<Operating Timing>

Figure 7A:
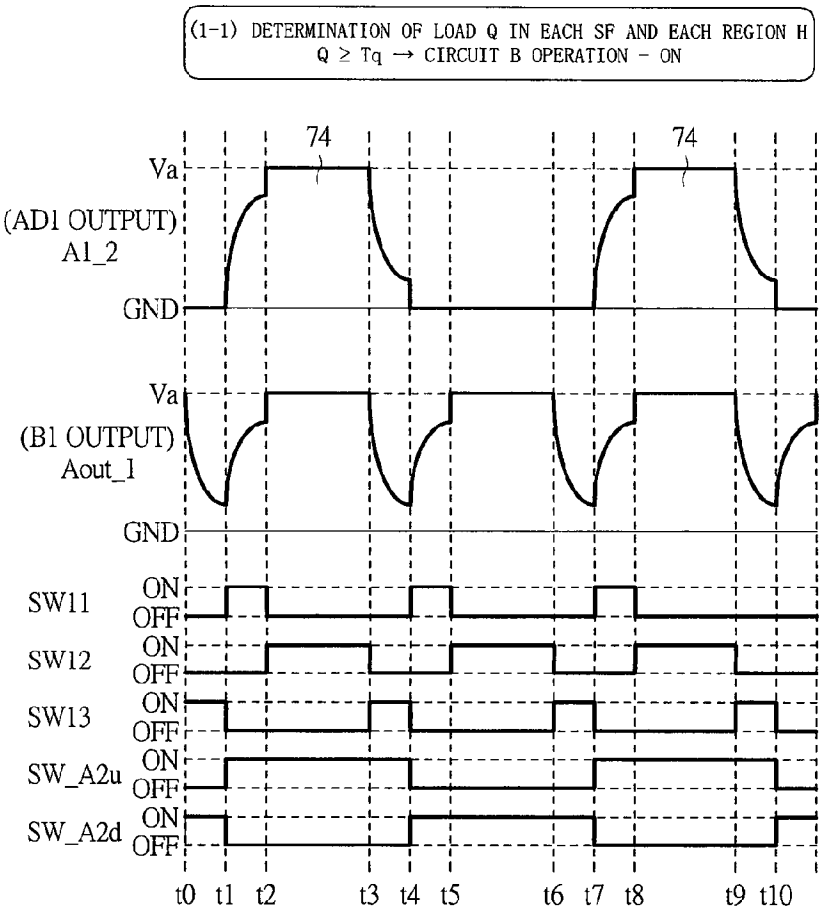
FIG. 7A is a diagram illustrating operation timings of the control in the PDP device according to the first embodiment of the present invention, in the case where the operation of the recovery circuit is turned ON when a load is large.
Figure 7B:
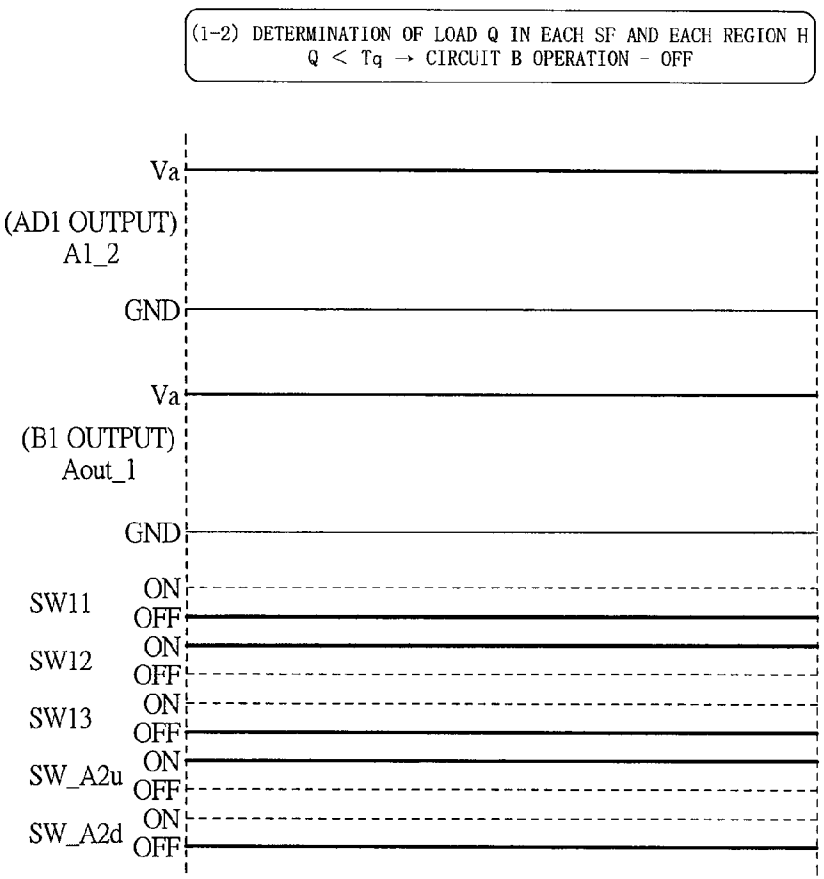
FIG. 7B is a diagram illustrating operation timings of the control in the PDP device according to the first embodiment of the present invention, in the case where the operation of the recovery circuit is turned OFF when the load is small.

FIGS. 7A and 7B illustrate waveforms of operation timings of the address driver 30 and the address energy recovery circuit 40, illustrating the case in which, as contents (conditions) of the control described above, the load (Q) is determined for each SF and for the region H of which the address energy recovery circuit (B) is in charge to perform the operation control. FIG. 7A illustrates the case in which, as a first control state, the operation of the recovery circuit (for example, B1) is turned ON when the load Q in the region H (for example, H1) is Q≧Tq, and also illustrates each waveform and timing in this case. As waveforms, from top, an output waveform from the address driver IC (for example, AD1), an output waveform (Aout_1) from the address energy recovery circuit (B), and switching waveforms from each of switches of these components (AD1 and B1). As an output from the address driver IC AD1, the case of A1_2 (an output to a second address electrode 13 (A2)) and waveforms from the switches (SW_A2*u* and SW_A2*d*) corresponding thereto are illustrated. Similarly, FIG. 7B illustrates the case in which, as a second control state, the operation of the recovery circuit (B1) is turned OFF when the load Q in the region H (for example, H1) is Q<Tq, and also illustrates switching waveforms, timing, and others of AD1 output (A1_2), B1 output (Aout_1), and each of the switches in each component in this case.

The operation state is as follows in FIG. 7B. In the recovery circuit B1, the switch SW11 is turned OFF, the switch S12 is turned ON, and the switch S13 is turned OFF. With this, the output Aout_1, which is an output from the recovery circuit B1, represents an address voltage Va. Also, in the address driver AD1, the switch SW_A2*u* is turned ON, and the switch SW_A2*d* is turned OFF. With this, the output A1_2, which is an output from the address electrode A1, represents an address voltage Va.

In FIG. 7A, details of operation timings when the address driving waveform (ON/OFF repetition) as in the first example illustrated in FIG. 4 is output are as follows. Here, t1 or the like represents a point of time. At a time to, the address pulse 74 is in an OFF state (the potential is at ground (GND)).

Upon activation, first at the time t1, the switch 11 is turned ON, the switch SW13 is turned OFF, the switch SW_A1*u* is turned ON, and the switch SW_A1*d* is turned OFF. With this, due to an LC resonant UP effect, the potential in the outputs Aout_1 and A1_2 is increased in a curved shape (in a curved shape in which the gradient gradually becomes gentle). Next, at a time t2, the switch SW11 is turned OFF, and the switch SW12 is turned ON. With this, due to the Va clamp UP effect, the potential in the outputs Aout_1 and A1_2 is abruptly increased until Va (that is, Va clamp UP). This is an ON state of the address pulse 74.

Upon deactivation, at a time t3, the switch SW12 is turned OFF, and the switch SW13 is turned ON. With this, due to an LC resonant DOWN effect, the potential in the outputs Aout_1 and A1_2 is decreased in a curved shape (in a curved shape in which the gradient gradually becomes gentle). Next, at a time t4, the switch SW1 is turned ON, the switch SW13 is turned OFF, the switch SW_A1*u* is turned OFF, and the switch SW_A1*d* is turned ON. With this, particularly with ON of the switch SW_A1*d*, the potential in the output Aout_1 is not decreased to GND, but is increased in a curved shape (in a curved shape in which the gradient gradually becomes gentle). The potential in the output A1_2 is abruptly decreased to GND. This is an OFF state of the address pulse 74. Here, clamp down control may be performed at the time t4 but, in that case, the output Aout_1 is decreased to GND, taking some driving time by that decrease. At a time t5, the switch SW11 is turned OFF, and the switch SW12 is turned ON. With this, the potential in the output Aout_1 is abruptly increased to Va. At a time t6, the switch SW12 is turned OFF, and the switch SW13 is turned ON. With this, the potential in the output Aout_1 is decreased from Va in a curved shape (in a curved shape in which the gradient gradually becomes gentle). The same goes for the following control.

As described above, according to the first embodiment, the load (Q) is determined for each divided screen area (H) in the horizontal direction to switch the operation of the recovery circuit (B). Thus, the address energy control can be more efficiently performed than the conventional technique (control over the screen area (R) across the board) to reduce address energy.

(Second Embodiment)

Next, with reference to FIGS. 8A and 8B, a PDP device and PDP driving method according to a second embodiment of the present invention will be described. In the second embodiment, in addition to the configuration of the first embodiment (such as determining the load (Q) for each horizontal-direction divided screen area (H)), the load (Q) is determined for each divided screen area (V) of a group of display lines (L) of the entire panel screen area (Q) in a vertical direction to determine ON/OFF of the operation of each address energy recovery circuit (B). With this, a more efficient address energy reduction can be achieved.

FIGS. 8A and 8B illustrate contents of control in the second embodiment in a form similar to that of FIGS. 5A and 5B. In contents (conditions) of the control according to the second embodiment, with each SF, each horizontal-direction divided screen area H of which the address energy recovery circuit (B) is in charge and each vertical-direction divided screen area V taken as a unit, the address pulse switching load (Q) is determined. Based on the determination result, ON/OFF of the operation (LC resonant switch control) of the address energy recovery circuit (B) corresponding to each region (H-V) is determined. With this ON/OFF of the operation, the address energy is recovered in the divided region (H-V), thereby reducing the address energy.

The screen area (R) and the group of display lines (L1 to Li) of the panel are managed as a plurality of (two, in this example) vertical-direction divided screen areas (V1 and V2). The entire screen area (R) is managed in region units in a predetermined rectangular shape based on dividing in horizontal and vertical directions (for example, a region unit is one region defined by crossing at H1-V1). The vertical-direction divided screen area V is a region configured by a plurality of successive display lines (L). In this example, the group of display lines (L1 to Lj) is, as the region V, divided into two regions (V1 and V2), that is, an upper region and a lower region. The region V1 is a region from L1 to L(j/2), and the region V2 is a region from L(j/2+1) to Lj. For example, the first address driver IC (AD1) 30-1 and the first address energy recovery circuit (B1) 40-1 are in charge of two regions, that is, an H1-V1 region and an H1-V2 region.

In FIG. 8A, at SF1, in the region H1, as an operation of the corresponding first address driver IC (AD1) during the address period (Ta) 72, an address driving waveform (group of address pulses) to a plurality (m lines) of corresponding address electrodes (A1 to Am) is alternately turned ON and OFF in the region V1, and is always OFF in the region V2. Also, in the next region H2, as an operation of the second address driver IC (AD2) 30-2, the address driving waveform is always ON in the region V1, and is alternately turned ON and OFF in the region V2. Furthermore, in the last region Hn, as an operation of the second address driver IC (ADn) 30-n, the address driving waveform is always OFF in the region V1, and is always ON in the region V2.

In FIG. 8B, at SFN, in the region H1, as an operation of AD1 during the address period (Ta) 72, the address driving waveform is always OFF in the region V1, and is alternately turned ON and OFF in the region V2. Further, in the region H2, as an operation of AD2, the address driving waveform is alternately turned ON and OFF in the region V1, and is always turned ON in the region V2. Furthermore, in the region Hn, as an operation of ADn, the address driving waveform is always ON in the region V1, and is always OFF in the region V2. The contents of the display data and operation are changed in any of these regions (regions of H1, H2, Hn, V1, V2 and their combination).

In FIGS. 8A and 8B, the load (Q) in each of the regions (in this example, six regions) is as illustrated. For each of the regions, according to the magnitude of the load (Q), ON/OFF of the operation of each of the plurality (n) of address energy recovery circuits (B) 40-1 to 40-n is determined as illustrated. For example, at SF1 in FIG. 8A, it is selected that the operation is turned ON in the H1-V1 region and the H2-V2 region, and it is selected that the operation is turned OFF in other regions.

As has been described in the foregoing, according to the second embodiment, the load (Q) is determined for each of the vertical-direction divided screen areas (V) to switch the operation of the address energy recovery circuit (B). Thus, the address energy control can be efficiently performed to reduce the address energy. In the structure according to the second embodiment, a region (H-V) obtained by dividing the entire screen area (R) in horizontal and vertical directions is taken as a unit of control. Similarly, a region (V) obtained by dividing the entire screen area (R) only in a vertical direction can be taken as a unit of control.

In the foregoing, the invention made by the inventors of the present invention has been concretely described based on the embodiments. However, it is needless to say that the present invention is not limited to the foregoing embodiments and various modifications and alterations can be made within the scope of the present invention.

INDUSTRIAL APPLICABILITY

The present invention can be used for PDP devices and others.

The invention claimed is:

1. A method comprising:

driving a plasma display panel to perform display on a screen area of the plasma display panel, the panel including sustain electrodes and scan electrodes in a first direction and including address electrodes in a second direction, the method using a subfield method, where one field time period is divided into a plurality of subfields, and an address-, display-period separation method, wherein:

the screen area of the panel, a group of display lines of the panel, and a group of display columns of the panel are respectively divided into a plurality of first regions (H) in the first direction and divided into a plurality of second regions (V) in the second direction, a plurality of address energy recovery circuit blocks are provided corresponding to the first regions (H), as an address energy recovery circuit that is connected to a group of the address electrodes of the panel and recovers energy, and for each of the subfields and for each of the first regions (H) of which the address energy recovery circuit blocks are respectively in charge, an operation of the address energy recovery circuit block corresponding to each first region (H) is turned ON or OFF for each of the second regions (V) according to a switching load of an address pulse applied to a group of address electrodes in each second region (V).

2. The method according to claim 1, wherein:

for each subfield and for each first region (H), the switching load of the address pulse applied to the group of address electrodes in each second region (V) is calculated based on display data, and the operation of the address energy recovery circuit block corresponding to each first region (H) is turned ON when the calculated switching load is larger than or equal to a threshold value and is turned OFF when the calculated switching load is smaller than the threshold value.

3. A plasma display device for performing display with a subfield technique, where one field time period is divided into a plurality of subfields, and an address-, display-period separation method, the plasma display device comprising:

a plasma display panel including sustain electrodes and scan electrodes in a first direction and including address electrodes in a second direction, wherein a group of the sustain electrodes, scan electrodes and address electrodes configures a screen area to have a display cell matrix, a group of display lines, and a group of display columns; and a control circuit configured to perform driving control of the panel, wherein:

the screen area of the panel, the group of display lines of the panel, and the group of display columns of the panel are respectively divided into a plurality of first regions (H) in the first direction and divided into a plurality of second regions (V) in the second direction, the control circuit includes an address driving circuit and an address energy recovery circuit which are connected to a group of address electrodes of the panel, the address driving circuit applies a group of address pulses to the group of address electrodes of the panel during an address period of one of the subfields according to display data, the address energy recovery circuit includes a coil and an LC resonant control switch and recovers energy from the group of address electrodes with an LC resonant operation between an inductance of the coil and a capacitance of the panel, as the address energy recovery circuit, a plurality of address energy recovery circuit blocks are provided corresponding to the first regions (H), and for each of the subfields and for each of the first regions (H) of which the address energy recovery circuit blocks are respectively in charge, the control circuit turns ON or OFF, for each of the second regions (V), an operation of the address energy recovery circuit block corresponding to each first region (H) according to a switching load of an address pulse applied to a group of address electrodes in each second region (V).

4. The plasma display device according to claim 3, wherein:

for each subfield and for each first region (H), the control circuit calculates, based on display data, the switching load of the address pulse applied to the group of address electrodes in each second region (V), and the control circuit turns ON the operation of the address energy recovery circuit block corresponding to each first region (H) when the calculated switching load is larger than or equal to a threshold value, and turns OFF the operation of the address energy recovery circuit block corresponding to each first region (H) when the calculated switching load is smaller than the threshold value.

* * * * *

UNITED STATES PATENT AND TRADEMARK OFFICE

CERTIFICATE OF CORRECTION

PATENT NO. : 8,269,693 B2
APPLICATION NO. : 12/667170
DATED : September 18, 2012
INVENTOR(S) : Akihiro Takagi It is certified that error appears in the above-identified patent and that said Letters Patent is hereby corrected as shown below:

On the Title Page, in Item "(87) PCT Pub No.", the publication number should read

--WO2009/004685-- rather than "WO2008/004685."

Signed and Sealed this
Sixth Day of August, 2013

Teresa Stanek Rea
*Acting Director of the United States Patent and Trademark Office*